US008317885B2

(12) United States Patent
Van Den Berg et al.

(10) Patent No.: US 8,317,885 B2
(45) Date of Patent: Nov. 27, 2012

(54) APPARATUS FOR GASIFYING FUEL WITH A DRIPPER EDGE AND HEAT SHIELD

(75) Inventors: Robert Erwin Van Den Berg, Amsterdam (NL); Dirk Lauterbach, Bilthoven (NL)

(73) Assignee: Shell Oil Company, Houston, TX (US)

( * ) Notice: Subject to any disclaimer, the term of this patent is extended or adjusted under 35 U.S.C. 154(b) by 1203 days.

(21) Appl. No.: 11/791,156

(22) PCT Filed: Nov. 21, 2005

(86) PCT No.: PCT/EP2005/056101

§ 371 (c)(1), (2), (4) Date: May 18, 2007

(87) PCT Pub. No.: WO2006/053905

PCT Pub. Date: May 26, 2006

(65) Prior Publication Data

US 2008/0034657 A1 Feb. 14, 2008

(30) Foreign Application Priority Data

Nov. 22, 2004 (EP) ..... 04105970

(51) Int. Cl.
*C10J 3/72* (2006.01)

(52) U.S. Cl. ..... 48/69; 48/62 R; 48/127.9

(58) Field of Classification Search ..... 48/62 R–62 A
See application file for complete search history.

(56) References Cited

U.S. PATENT DOCUMENTS

| | | | | |
|---|---|---|---|---|
| 4,157,244 | A * | 6/1979 | Gernhardt et al. | 48/62 R |
| 4,436,530 | A | 3/1984 | Child et al. | 48/197 |
| 4,852,997 | A | 8/1989 | Segerstrom et al. | 48/210 |
| 4,880,438 | A * | 11/1989 | Den Bleyker | 48/69 |
| 4,963,163 | A | 10/1990 | Clomburg, Jr. et al. | 48/210 |
| 5,230,717 | A * | 7/1993 | Ogawa et al. | 48/76 |
| 5,976,203 | A | 11/1999 | Deeke et al. | 48/62 |
| 6,284,324 | B1 * | 9/2001 | Whittaker | 427/452 |

FOREIGN PATENT DOCUMENTS

| | | |
|---|---|---|
| DE | 4109063 | 9/1992 |
| EP | 290087 | 11/1988 |
| EP | 318071 | 5/1989 |
| GB | 1501284 | 2/1978 |
| JP | 61207492 | 9/1986 |
| JP | 61243893 | 10/1986 |
| JP | 5086375 | 4/1993 |
| JP | 06017061 | 1/1994 |
| JP | 10017873 | 1/1998 |

OTHER PUBLICATIONS

International Search Report dated Feb. 15, 2006.

* cited by examiner

*Primary Examiner* — Imran Akram

(57) ABSTRACT

The invention provides an apparatus for gasifying a fuel to form synthesis gas wherein also a slag is formed. The apparatus comprises:

a pressure shell; a slag bath; a gasifier wall; a free-fall trajectory for slag; and a heat shield. The gasifier wall is arranged inside the pressure shell defining a gasification chamber. It comprises a converging wall part that is provided with a slag discharge opening, located above the quench fluid in the slag bath. The heat shield is arranged above the slag bath between the free-fall trajectory and the pressure shell. The heat shield has a wall structure for allowing passage of a cooling fluid, the wall structure comprising an upper wall part and a lower wall part. The lower wall part of the heat shield is essentially refractory free.

12 Claims, 1 Drawing Sheet

APPARATUS FOR GASIFYING FUEL WITH A DRIPPER EDGE AND HEAT SHIELD

PRIORITY CLAIM AND CROSS REFERENCE

The present application is a 35 U.S.C. 371 national stage filing of PCT/EP2005/056101 filed 21 Nov. 2005, which claims benefit of European patent application No. 04105970.0 filed 22 Nov. 2004.

FIELD OF THE INVENTION

The present invention relates to an apparatus and method for gasifying a fuel to form synthesis gas wherein also a slag is formed.

Such a gasifier apparatus can be part of a gaseous, liquid or solid fuel gasification plant, such as a coal gasification plant.

BACKGROUND OF THE INVENTION

In a coal gasification plant a pulverised carbonaceous fuel, such as coal, is transformed into a product gas consisting mainly of synthesis gas. The gasification plant typically comprises a gasifier apparatus comprising a gasification reactor wherein the pulverised carbonaceous fuel is gasified under high pressure and high temperature conditions. In such a gasifier apparatus, a wall surface is provided on which a slag can form out of the ashes. Such a wall surface can be provided in the form of a membrane wall such as described in for instance patent specification GB 1 501 284.

The slag is allowed to drip down along the wall surface, to a slag discharge opening or slag tap, where the slag is allowed to fall freely into a slag water bath where it can cool and solidify. This is described in, for instance, U.S. Pat. No. 4,852,997. Other gasification reactors are described in e.g. U.S. Pat. No. 4,436,530, DE 41 09 063 and U.S. Pat. No. 5,976,203.

The gasifier reactor described in mentioned U.S. Pat. No. 4,852,997 is provided with a skirt in the form of a hooded element around the area where the slag falls down from the slag tap. The skirt has a lower conical part, diverging when considered from top to bottom, and ending in a spray ring. The spray ring is functional to spray water on the slag bath to wet the slag floating on the slag bath water surface.

The skirt shown in mentioned U.S. Pat. No. 4,852,997 suffers from various problems. Since the free falling slag is molten and has a high temperature, the skirt is exposed to overheating damage.

It is an object of the present invention to minimise the above problem.

It is a further object to provide an alternative apparatus for gasifying a fuel.

SUMMARY OF THE INVENTION

One or more of the above or other objects are achieved by the present invention, by providing an apparatus for gasifying a fuel to form synthesis gas wherein also a slag is formed, the apparatus at least comprising:

- a pressure shell for maintaining a pressure higher than atmospheric pressure;
- a slag bath located in a lower part of the pressure shell, the slag bath comprising a quench fluid;
- a gasifier wall arranged inside the pressure shell defining a gasification chamber wherein during operation the synthesis gas can be formed, a lower part of the gasifier wall comprising a converging wall part that is provided with a slag discharge opening, located above the quench fluid in the slag bath;
- a free-fall trajectory for the slag, the free-fall trajectory extending downwardly between the slag discharge opening and the slag bath; and
- a heat shield arranged above the slag bath between at least part of the free-fall trajectory and the pressure shell, the heat shield comprising a wall structure for allowing passage of a cooling fluid, the wall structure comprising an upper wall part and a lower wall part, the upper wall part being located closer to the slag discharge opening than the lower wall part and the lower wall part being located closer to the slag bath than the upper wall part;
- wherein the lower wall part of the heat shield is essentially refractory free.

The wall structure preferably is a membrane wall structure and suitably comprises a tube wall structure for allowing passage of the cooling fluid.

The invention will be described hereinafter in more detail and by way of example, with reference to the non-limiting accompanying drawings.

In the Figures same reference signs relate to like components.

DETAILED DESCRIPTION OF THE INVENTION

Figure 1:
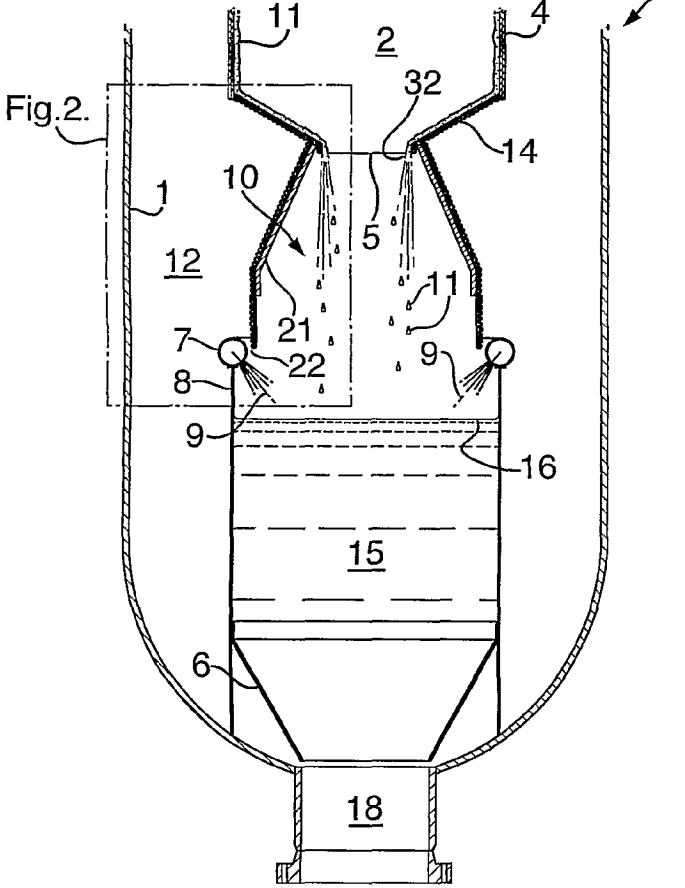
FIG. 1 schematically shows in cross-section a lower part of a gasification apparatus according to the invention.

Referring to FIG. 1 there is schematically shown a bottom end of a gasifier apparatus, or gasifier 3, provided for the generation of synthesis gas comprising at least CO and $H_2$. In a coal gasification plant this generally occurs by partially combusting a carbonaceous fuel, such as coal, at relatively high temperatures in the range of 1000° C. to 3000° C. and at a pressure range of about 1 to 70 bar, preferably 7 to 70 bar, in the presence of oxygen or oxygen-containing gases in the coal gasifier. The gasifier 3 may be a vertical oblong vessel, having an outer shell in the form of a pressure shell 1, preferably cylindrical, with substantially conical or convex upper and lower ends.

A gasification chamber 2 is defined by a surrounding gasifier wall 4, which may be (and preferably is) a membrane wall structure for circulation of cooling fluid. Typically, the gasifier 3 will have burners (not shown) in diametrically opposing positions, through which oxygen and fuel are passed to the gasification chamber 2, but this is not an essential element of the present invention. The gasification chamber 2 forms a reaction chamber where the fuel is partially oxidised to form synthesis gas.

The gasifier wall 4 assists in separating incombustible ash from the fuel during the combustion of the fuel. During operation, a slag 11 is formed and allowed to drip down to a converging wall part 14 that at the lower end thereof is provided with a slag discharge opening 5, or slag tap. The slag 11 is discharged through the slag discharge opening 5 where is falls along a free-fall trajectory (generally indicated with reference sign 10) downwardly into a slag bath 15 held in a slag bath container 8 in a lower part of the pressure shell 1. The slag bath container 8 can be filled with water as quench liquid.

The slag discharge opening 5 is preferably provided with a relatively sharp dripper edge 32 to promote the free falling of the slag into the slag bath 15.

The slag bath 15 is provided with a funnel 6 in which the slag 11 is collected. The flow of slag 11 is passed to discharge opening 18 of the slag water bath 15 where it is discharged together with water. A spray ring 7, supported on a spray ring support structure, is provided above the water level 16 to spray recycled water (schematically represented at 9) from the slag bath 15 onto the water surface 16 thereby facilitating the sinking of floating slag particles. In the described embodiment, the slag bath container 8 functions as the spray ring support structure. Alternatively, a separate spray ring support structure may be employed.

A heat shield 21 is provided between the free falling slag 11 and the pressure shell 1 to protect the pressure shell 1 from the heat of the slag 11 and hot synthesis gas that during operation is usually also present in the free-fall trajectory 10. The heat shield 21 comprises a membrane wall structure, for allowing passage of a cooling fluid. Cooling the heat shield 21 protects it against overheating that may occur if leaks are present in an optional refractory lining provided on the heat shield 21.

Due to the cooling capability, the heat shield 21 can also be refractory free or partially refractory free.

The heat shield 21 is arranged above the level 16 of water contained in the slag bath 15, in order to avoid unnecessary contact between the heat shield 21 and the water contained in the slag bath 15. At operative conditions the water can have an adverse corrosive impact on the heat shield 21.

By arranging the heat shield 21 inside the pressure shell 1, it does not have to be mechanically capable of holding a large pressure difference inside. In order to avoid significant pressure differences across the gasifier wall 4 and/or the heat shield 21 a breathing gap 22 has been provided between the spray ring 7 and the lower end of the heat shield 21.

Figure 2:
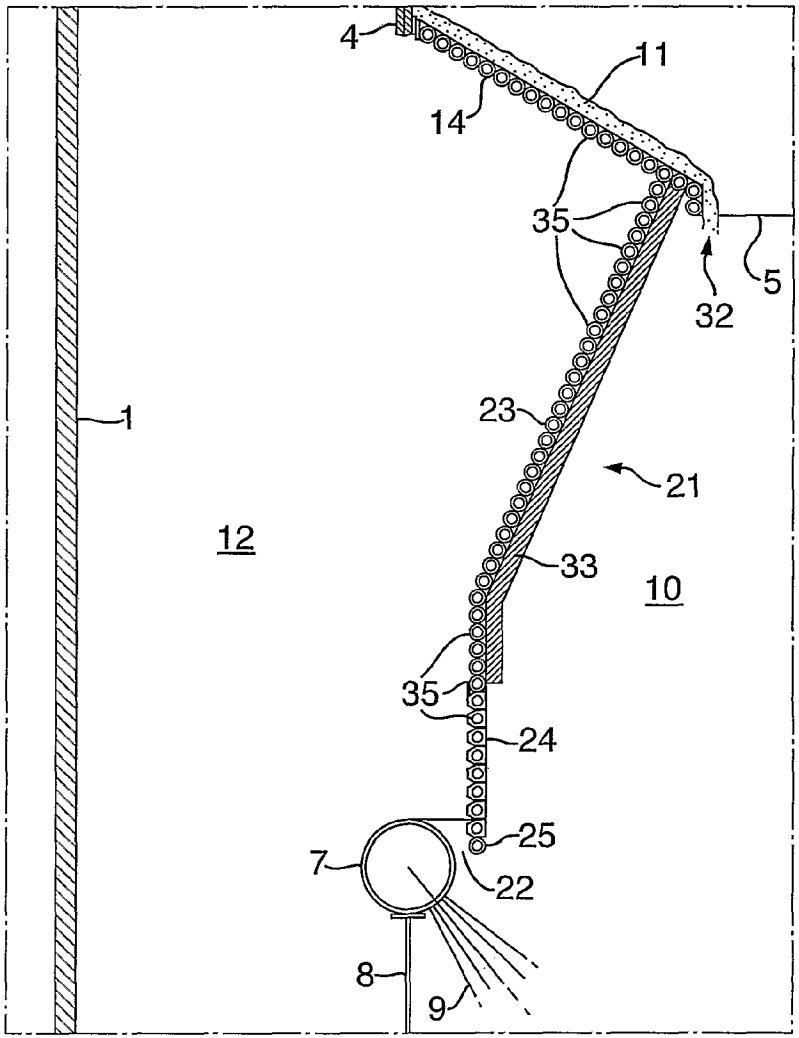
FIG. 2 schematically shows a detail of the gasification apparatus of FIG. 1, of an area that in FIG. 1 has been indicated by a dashed box.

Referring now to FIG. 2, the heat shield 21 has a tube wall structure 23,24 for allowing passage of a cooling fluid. The embodiment of FIGS. 1 and 2 has a plurality of horizontally disposed ring shaped tubes 35 fixed together, suitably by weld joints. Converging or diverging walls can be made by an assembly of ring shaped tubes having increasing or decreasing diameters with respect to their neighbouring ring shaped tubes.

Each ring shaped tube 35 can be provided with its own inlet and outlet for allowing supply and discharge of a cooling fluid. Depending on the local heat flux, two or more rings may alternatively be connected in series between one inlet and one outlet. This option can likely be attractive for the smaller rings.

Separate water supply and return lines are provided internally inside the pressure shell 1 to facilitate ease of replacing the heat shield 21 during a maintenance or repair shut down operation.

The cooling fluid supply can be dedicated exclusively for supplying the cooling fluid to the heat shield 21. This way, other internals do not share the same cooling fluid. Should a leak develop in the heat shield 21, for instance as a result of corrosion or thermal stresses, then other internals are not adversely subjected to a cooling fluid deficit. Moreover, the inflow and outflow of cooling fluid in and from the heat shield 21 can be monitored during operation in order to detect any deficit that is indicative of a leak. Water is a suitable cooling fluid.

In the embodiment of FIGS. 1 and 2 also the converging wall part 14 of the gasifier wall 4 is formed of an assembly of ring shaped tubes 35. Preferably substantially the whole gasifier wall 4 is formed of these ring shaped tubes 35.

The heat shield 21 extends downwardly from the gasifier wall 4, and is preferably sealingly connected thereto in order to prevent passage of hot synthesis gas into the annular space 12 between the heat shield 21 and the pressure shell 1 and circulating back to the slag bath space through breathing gap 22.

The heat shield 21 of the preferred embodiment extends as a skirt around the free-fall trajectory 10. The heat shield 21 comprises an upper wall part 23 and a lower wall part 24. The upper wall part 23, which is located between the lower wall part 24 and the converging wall part 14 of the gasifier wall 4 has a diverging section when seen in the falling direction of the slag.

The upper wall part 23 of the heat shield 21 is preferably protected with a layer of refractory material 33. Due to a preferred insulating property of the refractory material 33, unnecessary leakage of heat from the gasification chamber 2 to the cooled heat shield 21 is minimised. The refractory material 33 is suitably formed of Plyram SiC L3001, and suitable has a layer thickness of between 10 and 20 mm, more preferably about 14 mm. The refractory material 33 is suitably secured and supported by means of anchors (not shown), suitably made of AlSi 310 ss. The anchors may typically have a diameter of approximately 10 mm.

The heat shield 21, or at least its lower part 24, which has a relatively high risk of contacting water in the slag bath 15, is suitably made of a corrosion-resistant metal, such as for instance a Nickel-chromium based super alloy, preferably also containing Molybdenum, preferably containing other alloying elements to enhance resistance to chemical corrosion. A suitable Ni—Cr based super alloy, sold under the name of Incoloy 825, is available in an austenitic phase having a composition within the ranges as set out in Table I.

TABLE I compositional ranges of Incoloy 825 (wt. %)

| Element | Min. | Max. | Typical |
|---|---|---|---|
| Ni + Co | 38.0 | 46.0 | 42.0 |
| Cr | 19.5 | 23.5 | 21.5 |
| Fe | Balance (>22) | | 28.5 |
| Si | | 0.50 | 0.50 |
| Mo | 2.5 | 3.5 | 3.0 |
| Mn | | 1.0 | 1.0 |
| C | | 0.05 | 0.05 |
| Al | | 0.2 | 0.20 |
| Ti | 0.6 | 1.2 | 0.90 |
| Cu | 1.50 | 3.00 | 2.25 |
| S | | 0.03 | 0.03 |
| P | | 0.03 | 0.03 |

Other materials, including low alloy steel, and particularly those having a good corrosion resistance against phosphoric and sulphuric acids in either oxidising or reducing environments, can be used instead.

The lower wall part 24 is essentially cylindrically arranged around the free-fall trajectory 10. It has a smooth inside surface facing the free-fall trajectory 10. The smooth inside surface may be provided in the form of a large tube arranged around the free-fall trajectory 10 that is cooled by a plurality of tubes 35 for cooling fluid arranged around the large tube in close contact therewith. In the embodiment as shown in FIG. 2, the lower wall part 24 comprises a plurality of cylindrically arranged super omega tubes, each having an Ω-shaped cross section or a cross-section with a straight contour section. The smooth inside surface is then obtained by welding the successive straight contour sections together such that they form a smooth surface.

The last tube 25 in the heat shield is provided in the form of a normal ring shaped tube having a circular cross-section.

The lower wall part 24 is not provided with a layer of refractory material. If it would be provided with a layer of refractory material, it would spall off when the heat shield 21 would incidently be immersed in the slag bath quenching liquid.

During operation, small droplets of liquid slag 11, so-called fly slag, may come in contact with the refractory-free part of the heat shield 21. Without intending to be bound by the following hypothesis, it is anticipated that, the heat shield inner surface facing the free-fall trajectory, will be covered with a layer of solidified slag. This is advantageous compared to a case where liquid slag is in contact with a (hot) uncooled heat shield, because alkali compounds in the slag 11 may be corrosive in liquid slag while the slag becomes inert upon solidification. Thus, the solid slag provides a protective layer.

The gasifier apparatus according to the invention has a number of advantages. Passage of cooling fluid through the membrane wall structure enables cooling of the heat shield.

The heat shield may, in at least a part thereof, be provided with a layer of refractory material to protect it against the heat of hot synthesis gas and falling slag, and to provide an insulating layer between the coolable heat shield membrane wall structure for avoiding unnecessary loss of heat from the gasification chamber. Overheating damage of the heat shield that may result from deterioration of the refractory layer, is avoided by the cooling capability.

However, due to the cooling capability presence of a refractory layer is not required. An at least partially refractory-free heat shield can be provided instead. Having a cooling capability on the heat shield thus provides a possibility of maintaining an at least partially refractory free heat shield.

In areas where there can be contact between the quench liquid in the slag bath and the heat shield, a refractory protection may inadvertently spall off, leading to unnecessary local variations in the temperature in the heat shield which may lead to mechanical stresses that may eventually cause a leakage in the heat shield's membrane wall structure. Moreover, parts of spalled off refractory material may cause blockages downstream in the slag bath and slag discharge system.

It is therefore particularly advantageous to provide an essentially refractory-free lower wall part of the heat shield, whereby said lower wall part is located closer to the slag bath than an upper wall part of the heat shield, said upper wall part being located closer to the slag discharge opening than the lower wall part. Such preferred arrangement is better suited for incidental contact with the quench liquid in the slag bath than a heat shield that is provided with refractory layer in its lower part.

What is claimed is:

1. An apparatus for gasifying a fuel to form synthesis gas wherein also a slag is formed, the apparatus comprising:

a pressure shell for maintaining a pressure higher than atmospheric pressure;

a slag bath located in a lower part of the pressure shell, the slag bath comprising a quench fluid;

a gasifier wall arranged inside the pressure shell defining a gasification chamber wherein during operation the synthesis gas can be formed, a lower part of the gasifier wall comprising a converging wall part that is provided with a slag discharge opening having a dripper edge located above the quench fluid in the slag bath;

an open space forming a free-fall trajectory for the slag, the open space extending downwardly between the slag discharge opening and the slag bath; and a heat shield arranged below the dripper edge and above the slag bath between at least part of the free-fall trajectory and the pressure shell, the heat shield comprising a wall structure for allowing passage of a cooling fluid, the wall structure comprising an upper wall part and an essentially refractory-free lower wall part, the upper wall part being located closer to the slag discharge opening than the lower wall part and the lower wall part being located closer to the slag bath than the upper wall part.

2. The apparatus according to claim 1, wherein the heat shield extends downwardly from the gasifier wall.

3. The apparatus according to claim 2, wherein the heat shield is sealingly connected to the gasifier wall to prevent passage of synthesis gas.

4. The apparatus according to claim 1, wherein the heat shield is provided in the form of a skirt around the free-fall trajectory.

5. The apparatus according to claim 1, wherein the wall structure comprises a tube wall structure.

6. The apparatus according to claim 5, wherein the tube wall structure comprises one or more ring shaped tubes horizontally disposed around the free-fall trajectory.

7. The apparatus according to claim 1, wherein the wall structure is provided with a smooth wall section having a smooth surface facing the free-fall trajectory.

8. The apparatus according to claim 1, wherein the smooth wall section is comprised in the lower wall part.

9. The apparatus according to claim 1, wherein at least a part of the upper wall part of the heat shield is covered with a layer of a refractory material.

10. The apparatus according to claim 1, wherein the upper wall part of the heat shield comprises a diverging wall section when considered along a free-fall direction and wherein the lower wall part extends essentially cylindrically around the free-fall trajectory.

11. The apparatus according to claim 1, wherein the gasifier wall arranged inside the pressure shell and defining the gasification chamber is substantially composed of a wall structure for allowing passage of a second cooling fluid.

12. The apparatus according to claim 1, wherein the pressure shell and the heat shield define an annular space.

* * * * *